US007549478B2

(12) United States Patent
Khomynets

(10) Patent No.: US 7,549,478 B2
(45) Date of Patent: Jun. 23, 2009

(54) WELL JET DEVICE AND THE OPERATING METHOD THEREOF

(76) Inventor: Zinoviy Dmitrievich Khomynets, kv.4, d.46, Zeleny pr-t, Moscow (RU) 111396

( * ) Notice: Subject to any disclaimer, the term of this patent is extended or adjusted under 35 U.S.C. 154(b) by 0 days.

(21) Appl. No.: 12/089,904

(22) PCT Filed: Jul. 7, 2006

(86) PCT No.: PCT/RU2006/000356

§ 371 (c)(1),
(2), (4) Date: Apr. 10, 2008

(87) PCT Pub. No.: WO2007/061334

PCT Pub. Date: May 31, 2007

(65) Prior Publication Data

US 2008/0245572 A1 Oct. 9, 2008

(30) Foreign Application Priority Data

Nov. 25, 2005 (RU) ..... 2005136548

(51) Int. Cl.
*E21B 43/00* (2006.01)
*F04F 5/00* (2006.01)

(52) U.S. Cl. ..... 166/372; 417/167; 417/172

(58) Field of Classification Search ..... 166/66, 166/68, 105, 250.01, 250.11, 254.2, 372; 417/54, 76, 84, 167, 170, 172, 176
See application file for complete search history.

(56) References Cited

U.S. PATENT DOCUMENTS 4,744,730 A * 5/1988 Roeder ..... 417/172
2004/0071557 A1* 4/2004 Khomynets ..... 417/172

FOREIGN PATENT DOCUMENTS

RU 2176336 C1 * 11/2001
RU 2222717 C1 * 1/2004
SU 972051 A * 11/1982
SU 1689594 A1 * 11/1991

* cited by examiner

*Primary Examiner*—Jennifer H Gay
*Assistant Examiner*—Daniel P Stephenson
(74) *Attorney, Agent, or Firm*—patenttm.us

(57) ABSTRACT

Well jet device comprises a packer mounted on a pipe string provided with a central channel embodied therein and jet pump. The pump has channels supplying a working medium to a nozzle, removing the media mixture and supplying a medium pumped from the well, respectively. Said nozzle is connected to the annular space by the channels and the channel is connected to the pipe string internal cavity through the channel on the side, where the diffuser of the pump enters and exits. A working medium flow switch is arranged in the body. An annular channel communicating with the channel via the channel and the nozzle is above said abutment flange and the steady bush comprises bypass holes and mounting seat for mounting a sealing unit with a hole for passing a logging cable with instruments therethrough or for arranging a depression insert provided with a return valve.

3 Claims, 3 Drawing Sheets

WELL JET DEVICE AND THE OPERATING METHOD THEREOF

FIELD OF THE INVENTION

This invention relates to pumping equipment, primarily to well pump units used in testing and developing oil and gas wells.

PRIOR ART

A well jet device is known, which comprises, arranged on a pipe string from bottom to top, a packer with a central channel made in it and a jet pump, which body comprises an active nozzle and a mixing chamber with a diffuser as well as a channel for supplying a working medium and a channel for supplying a medium pumped out of a well, wherein the jet pump body is provided with a through channel for the purpose of installing replaceable functional inserts and a sealing unit therein (RU 2176336 C1).

The same patent teaches a method of operating a well jet device, including arranging a jet pump on a flow string in a well and pumping chemical agents via the flow string into a formation subject to subsequent pumping reaction products out of the formation, wherein a blocking insert with a through channel is firstly installed in the through channel made in the jet pump body, and then the blocking insert is replaced by a depression insert, a working medium is supplied to the jet pump nozzle via the flow string, thus creating a controlled pressure in the under-packer area for the purpose of draining the formation and carrying out other scheduled works.

This well jet device enables to treat a formation below the level at which a jet pump is installed in a well, including treatments carried out after creating a pressure differential above and below a sealing unit. However, the capabilities of the well jet device are not used in full due to long times required for replacing inserts, wherein such time is often longer than estimated time of the reaction between an acid solution and minerals of a producing formation.

The closest to this invention as to its technical essence and achieved result is a well jet device comprising a packer with a central channel made therein and a jet pump, both being arranged on a pipe string, wherein an active nozzle, a mixing chamber with a diffuser, and a channel for supplying a working medium, a channel for supplying a medium pumped out of a well are made in the body of the jet pump, a working medium flow switch being installed in the body of the jet pump, the jet pump output being connected to the annular space surrounding the pipe string, the jet pump nozzle being connected, via the channel for supplying a working medium, to the pipe string inner cavity above the switch, and the channel for supplying a medium pumped out of a well is connected to the pipe string inner cavity below the packer (RU 2222717 C1).

A method of operating a well jet device is known from the said patent, which consists in that a packer and a jet pump having a working medium flow switch installed therein are lowered into a well on a pipe string, the packer and the jet pump are arranged over the top of a producing formation, and the packer is released. Then a working medium is injected to the jet pump nozzle with the use of a pump unit at regular intervals, thus creating a pressure drawdown to the producing formation, then the flow direction of the working medium is reversed, and back-pressure on the producing formation is created as a hydraulic blow by acting on the producing formation with the working medium pressure from the pipe string. After that the supply of all the working medium is abruptly switched to the jet pump nozzle, which allows to repeat the above-described cycle of acting on the near-well area of the producing formation by pressure drawdown and back-pressure, while determining a degree to which permeability of the near-well area of the producing formation is restored by regularly taking check measurements of the well production rate before and during cyclic actions on the near-well area of the producing formation, with the possibility of injecting an acid solution to the producing formation by the jet pump.

This well jet device enables to switch over the working medium flow and act on a producing formation by creating pressure drawdown and back-pressure. However, the flow switch used creates significant hydraulic resistance and occupies the flow section of the pipe string, which does not enable to lower equipment and various instruments, e.g., measuring instruments and instruments used for acting on formations, into a well, which narrows the capabilities of this well jet device and those of its method of operation.

BRIEF DESCRIPTION OF THE INVENTION

The objective of this invention is to raise quality of works on increasing well production rates due to improving technologies of treating producing formation with liquid agents.

The technical effect achieved by realizing this invention is improvements in work reliability and the well jet device capacity when treating a producing formation.

The stated objective in respect of the device can be solved, and the stated technical effect can be achieved due to the fact that the inventive well jet device comprises, arranged on a pipe string from bottom to top, a packer with a central channel made in it and a jet pump, which body comprises a nozzle and a mixing chamber with a diffuser as well as a channel for supplying a working medium to the nozzle, a channel for withdrawing a medium mixture and a channel for supplying a medium pumped out of a well, wherein the jet pump nozzle is connected via the channel for supplying a working medium to the annular space surrounding the pipe string, and the channel for supplying a medium pumped out of a well and the diffuser output via the channel for withdrawing a medium mixture are connected to the inner cavity of the pipe string. Further, a working medium flow switch is installed in the jet pump body, coaxially with the pipe string, the switch being made as a supporting sleeve spring-loaded against the body and movable along the axial direction, the sleeve having a thrust flange arranged in a bore made in the body, and, above the supporting sleeve thrust flange, in the pump body an annular channel being made, which is connected to the channel for supplying a working medium through the channel for supplying a pumped-out medium and the nozzle; and bypass openings are made in the supporting sleeve as well as a mounting seat for the purpose of installing onto it a sealing unit lowered through the pipe string, said sealing unit having an axial opening for passing through it a logging cable or a wire with logging instruments hanged thereon and used for measuring physical parameters of a well and a medium pumped out of it, and for determining its production rate, or for installing onto the mounting seat a depression insert with a check valve and self-contained instruments hanged below it and used for measuring physical parameters of a medium pumped out of a well and capable of recording formation pressure recovery curves in the under-packer area, wherein, when the supporting sleeve is in its initial upper position, the output of the channel for withdrawing a medium mixture and the channel for supplying a pumped-out medium are closed by the sleeve, and when the supporting sleeve is in its lower position its upper end is located below the output of the channel for withdrawing a medium mixture and the bypass openings of the supporting sleeve being in communication with the input of the channel for supplying a medium pumped out of a well.

The stated objective in respect of the device can also be solved, and the stated technical effect can be achieved due to the fact that the length of the pipe string below the jet pump body may be made with an inner diameter at least 10 % less than the inner diameter of the pipe string above the jet pump body.

The stated objective in respect of the method can be solved, and the stated technical effect can be achieved due to the fact that the method of operating the well jet device consist in that a packer and a jet pump are lowered into a well on a pipe string, the channel for withdrawing a medium mixture and the channel for supplying a pumped-out medium being closed by the supporting sleeve that is spring-loaded against the jet pump body, the packer is released, and then an acid solution and/or a hydrofracturing fluid is pumped into a producing formation in the well, logging instruments are lowered through the pipe string into the well on a logging cable or a wire passed through the axial opening of the sealing unit, the logging instruments are arranged in the area of the producing formation, and the sealing unit is installed onto the mounting seat in the supporting sleeve located in the jet pump body, geo-physical parameters in the under-packer area, including those in the area of the producing formation, are recorded, then a pressurized working medium is injected along the annular space surrounding the pipe string, which acts on the thrust flange of the supporting sleeve together with the sealing unit through the channel for supplying a working medium, the nozzle, the channel for supplying a pumped-out medium and the annular channel and moves the supporting sleeve into its lower position, thus opening the output of the channel for withdrawing a medium mixture and establishing communication between the bypass openings and the input of the channel for supplying a medium pumped out of a well; at the same time the well is drained by injecting a pressurized working medium through the channel for supplying a working medium and to the jet pump nozzle, and reaction products and/or a hydrofracturing fluid are removed from the producing formation, while regularly measuring the well production rate with the use of logging instruments at 2-5 values of pressure drawdown on the producing formation and continuously recording bottom-hole pressures and the composition of a liquid medium pumped out of the producing formation; further, in the course of draining the well, the logging instruments are moved along the well bore for the purpose of recording geo-physical parameters in the under-packer area, including those in the area of the producing formation; and, afterwards, the supply of a working medium is stopped, the logging instruments are removed from the well together with the sealing unit and the logging cable or the wire, thus moving the spring-loaded supporting sleeve into its upper position, a depression insert, together with a check valve and self-contained instruments arranged below the depression insert, is installed onto the mounting seat; then a pressurized working medium is injected through the annular space surrounding the pipe string and, under the influence of said working medium, the supporting sleeve is moved into its lower position, and the producing formation is drained for the second time; then the supply of the working medium into the jet pump nozzle is stopped, and a formation pressure recovery curve is recorded for the under-packer space of the well.

A conducted analysis of the well jet device operation has shown that the device operation reliability and efficiency may be increased by optimizing the device design and, due to it, it becomes possible to clean near-well areas of producing formations in wells more fully and shorten time required for conducting such works.

It has been found that hydrodynamic influence on the near-well area enables to use the well jet device most efficiently while developing and repairing oil and gas wells in the course of works on intensifying oil inflow from a producing formation. The inventive well jet device enables to take check measurements both before and during treatment, which, in its turn, enables to assess the technical condition of a well and properties of a medium pumped out of a well. After studying an inflow it becomes possible to assess quality of treatment of the near-well area of a producing formation. Making the well jet device with a working medium flow switch in the form of a supporting sleeve spring-loaded against the body enables to treat a producing formation by injecting chemical agents and/or a hydrofracturing fluid. Such a supporting sleeve closes the channels for withdrawing a medium mixture and a pumped-out medium, thus preventing chemical agents and/or a hydrofracturing fluid from entering into the annual space. Making a supporting sleeve with a mounting seat enables to install various technological equipment into the sleeve and conduct hydrodynamic treatment of a producing formation as well as make measurements, including recording of a formation pressure recovery curve for the under-packer area, as well as create stepwise pressure drawdown on a producing formation and clean it from mud particles and products of a reaction after treating a producing formation with chemical agents. Thus, it becomes possible to increase a radius and quality of treatment of the producing formation near-well area, while significantly equalizing the inflow profile due to a fuller coverage of such a producing formation throughout its depth with hydrodynamic action.

DESCRIPTION OF PREFERRED EMBODIMENTS

Figure 1:
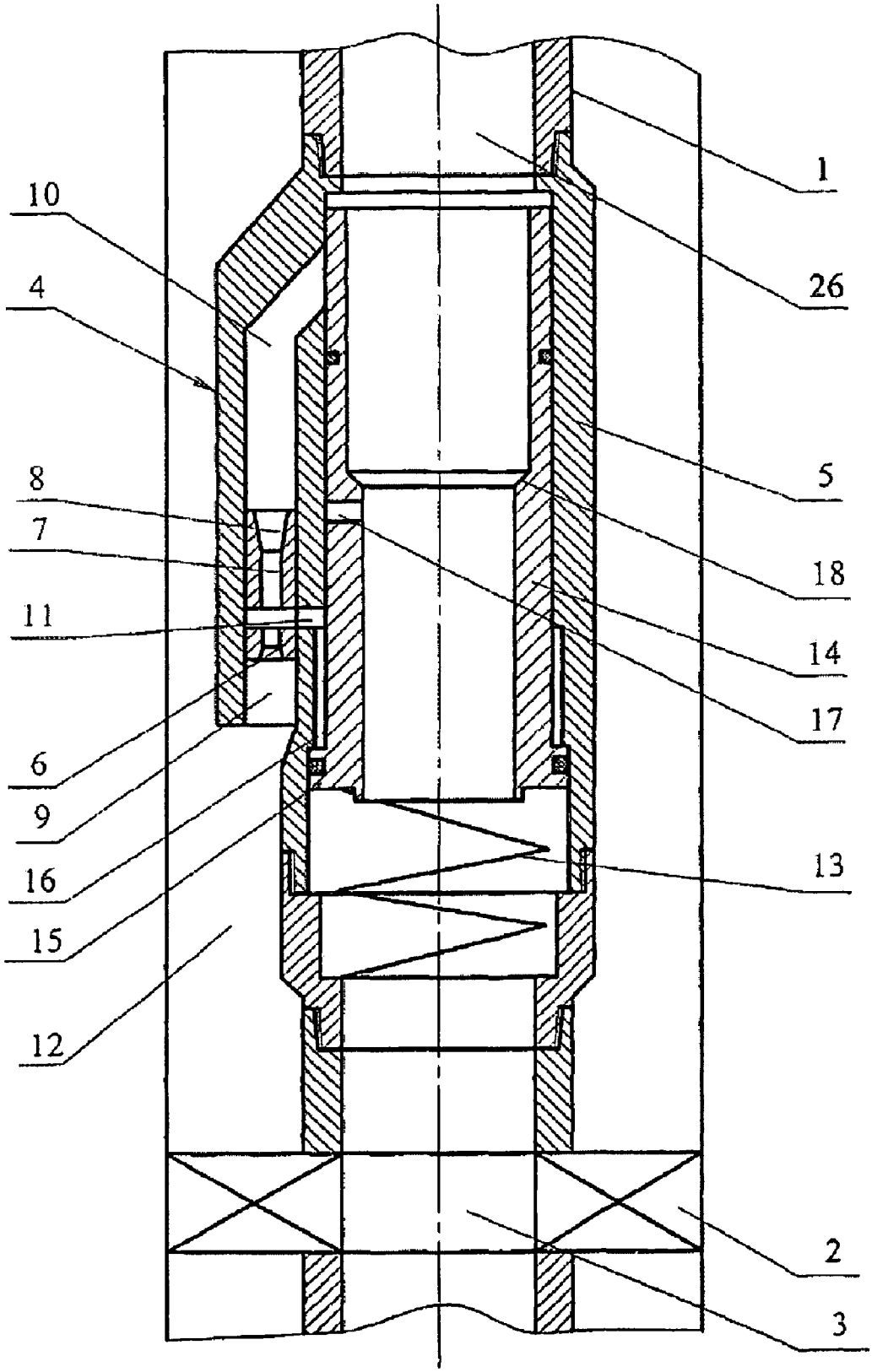
FIG. 1 shows the claimed well jet device intended for realization of the described method of operation when treating a producing formation with chemical agents or a hydrofracturing fluid.
Figure 2:
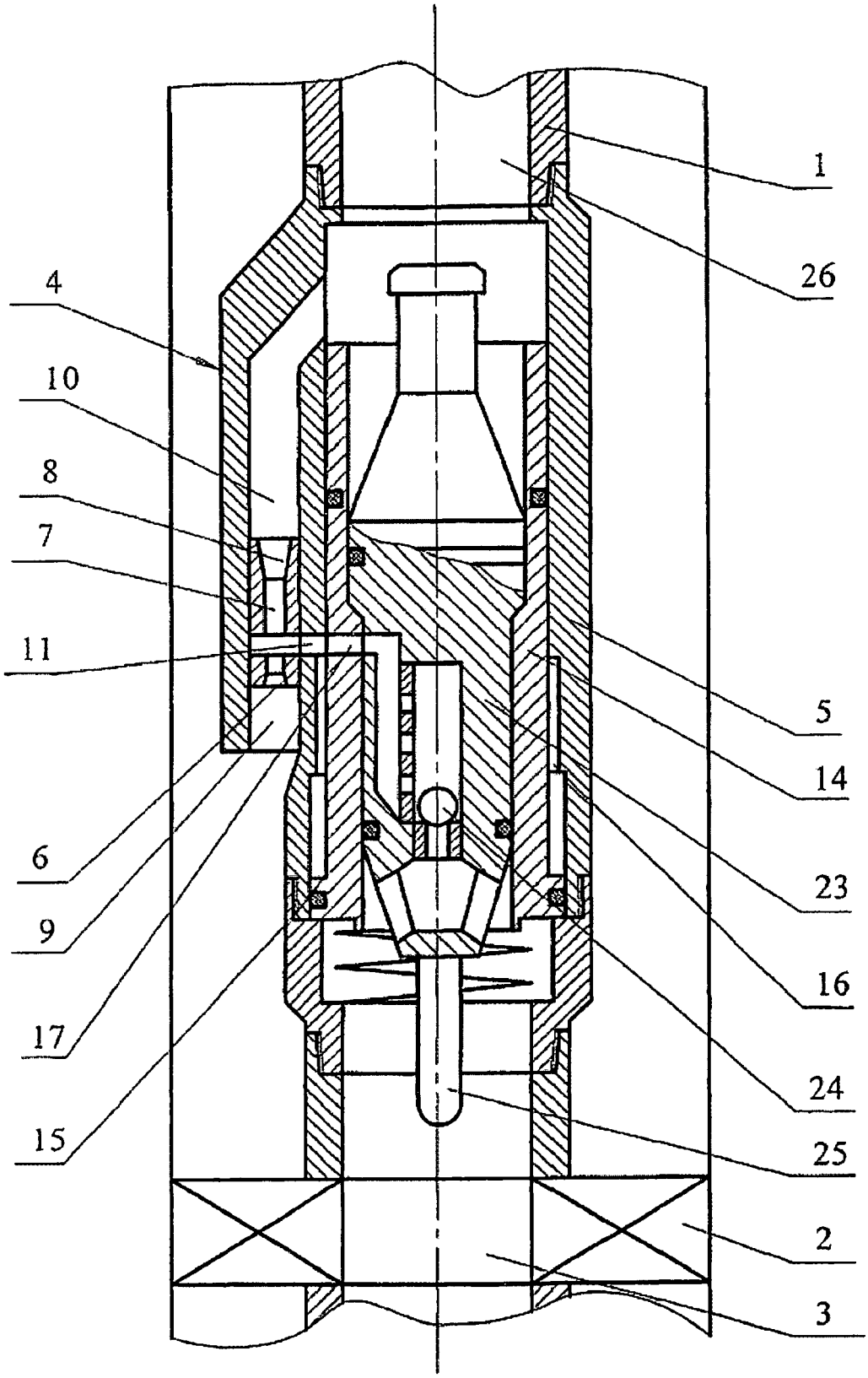
FIG. 2 shows the claimed well jet device with a depression insert, together with a check valve and self-contained instruments, installed in the supporting sleeve.
Figure 3:
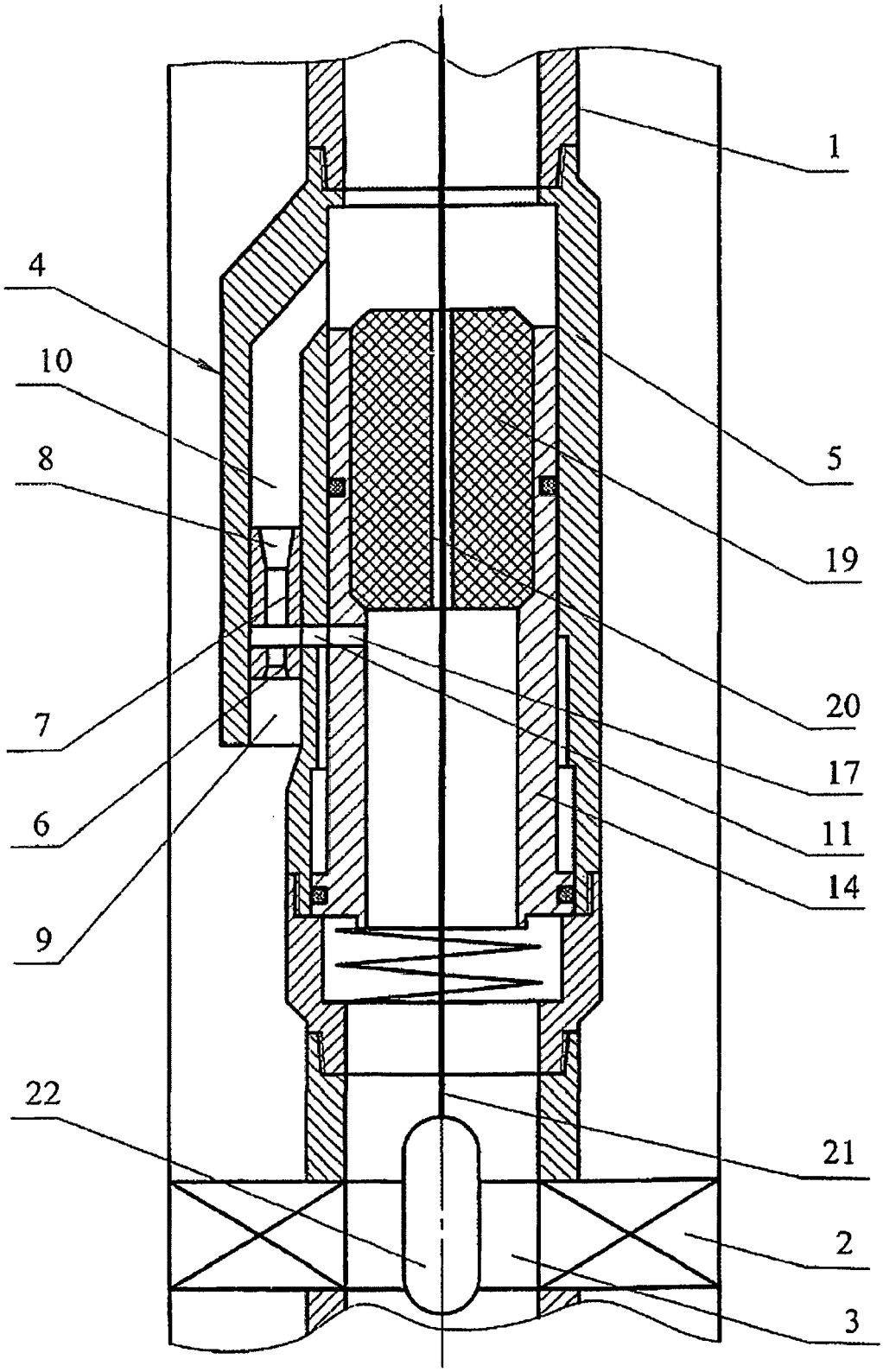
FIG. 3 shows the claimed well jet device with a sealing unit installed in the supporting sleeve.

The claimed well jet device comprises, arranged on a pipe string 1 from bottom to top, a packer 2 with a central channel 3 made in it and a jet pump 4. The body 5 of the jet pump 4 comprises a nozzle 6 and a mixing chamber 7 with a diffuser 8 as well as a channel 9 for supplying a working medium to the nozzle 6, a channel 10 for withdrawing a medium mixture and a channel 11 for supplying a medium pumped out of a well. The nozzle 6 of the jet pump 4 is connected via the channel 9 for supplying a working medium to the annular space 12 surrounding the pipe string 1. The input of the channel 11 for supplying a medium pumped out of a well and the output of the diffuser 8 via the channel 10 for withdrawing a medium mixture are connected to the inner cavity 26 of the pipe string 1. A working medium flow switch is installed coaxially with the pipe string in the body 5 of the jet pump 4, the switch being made as a supporting sleeve 14 spring-loaded by a spring 13 against the body 5 and movable along the axial direction, the sleeve 14 having a thrust flange 15 arranged in a bore made in the body 5. Above the thrust flange 15 of the supporting sleeve 14 in the pump body 5 an annular channel 16 is made, which is connected to the channel 9 for supplying a working medium through the channel for supplying a pumped-out medium and the nozzle 6. Bypass openings 17 and a mounting seat 18 are made in the supporting sleeve 14, said mounting seat 18 is used for the purpose of installing onto it a sealing unit 19 with an axial opening 20, which is lowered through the pipe string 1, said axial opening 20 is used for passing through it a logging cable or a wire 21 with logging instruments 22 hanged thereon and used for measuring physical parameters of a well and a medium pumped out of it, and for determining its production rate, or for installing onto the mounting seat 18 a depression insert 23 with a check valve 24 and self-contained instruments 25 hanged below it and used for measuring physical parameters of a medium pumped out of a well and capable of recording formation pressure recovery curves in the under-packer area. When the supporting sleeve 14 is in its initial upper position, the output of the channel 10 for withdrawing a medium mixture and the channel 11 for supplying a pumped-out medium are closed by the supporting sleeve 14. When the supporting sleeve 14 is in its lower position its upper end is located below the output of the channel 10 for withdrawing a medium mixture, the bypass openings 17 of the supporting sleeve 14 being in communication with the input of the channel 11 for supplying a medium pumped out of a well.

The length of the pipe string 1 below the body 5 of the jet pump 4 is made with an inner diameter at least 10% less than the inner diameter of the pipe string 1 at the length above the body 5 of the jet pump 4.

The claimed method of operating the well jet device is carried out as follows.

A packer 2 and a jet pump 4 are lowered into a well on a pipe string 1, the channel 10 for withdrawing a medium mixture and the channel 11 for supplying a pumped-out medium being closed by the supporting sleeve 14 that is spring-loaded against the body 5 of the jet pump 4. The packer 2 is released, and then an acid solution and/or a hydrofracturing fluid is pumped through the pipe string 1 into a producing formation of the well. Logging instruments 22 are lowered through the pipe string 1 into the well on a logging cable or a wire 21 passed through the axial opening 20 of the sealing unit 19. The logging instruments 22 are arranged in the area of the producing formation. The sealing unit 19 is installed onto the mounting seat 18 in the supporting sleeve 14 located in the body 5 of the jet pump 4. Geo-physical parameters in the under-packer area, including those in the area of the producing formation, are recorded a pressurized working medium is injected along the annular space 12 surrounding the pipe string 1, which acts on the thrust flange 15 of the supporting sleeve 14 through the channel 9 for supplying a working medium, the nozzle 6, the channel 11 for supplying a pumped-out medium and the annular channel 16 and moves the supporting sleeve 14 together with the sealing unit 19 into its lower position, thus opening the output of the channel 10 for withdrawing a medium mixture and establishing communication between the bypass openings 17 and the input of the channel 11 for supplying a medium pumped out of a well. At the same time the well is drained by injecting a pressurized working medium through the channel 9 for supplying a working medium and to the nozzle 6 of the jet pump 4, and reaction products and/or a hydrofracturing fluid are removed from the producing formation, while regularly measuring the well production rate with the use of the logging instruments 22 at 2-5 values of pressure drawdown on the producing formation and continuously recording bottom-hole pressures and the composition of a liquid medium pumped out of the producing formation. Then, in the course of draining the well, the logging instruments 22 are moved along the well bore for the purpose of recording geo-physical parameters in the under-packer area, including those in the area of the producing formation. Afterwards, the supply of a working medium is stopped, the logging instruments 22 are removed from the well together with the sealing unit 19 and the logging cable or the wire 21, thus moving the spring-loaded supporting sleeve 14 into its upper position, and the depression insert 23, together with a check valve 24 and self-contained instruments 25 arranged below the depression insert 23, is installed onto the mounting seat. Then a pressurized working medium is injected through the annular space 12 surrounding the pipe string 1 and, under the influence of said working medium the supporting sleeve 14 is moved into its lower position, and the producing formation is drained for the second time. Then the supply of the working medium into the nozzle 6 of the jet pump 4 is stopped, and a formation pressure recovery curve is recorded for the under-packer space of the well with the use of the self-contained instruments 25.

INDUSTRIAL APPLICABILITY

The present invention may be used in the oil and gas industry for well development after drilling or for underground repairs of wells for the purpose of intensifying hydrocarbons production rates or increasing intake capacity of injection wells.

What is claimed is:

1. A well jet device, comprising, arranged on a pipe string from bottom to top, a packer with a central channel made therein and a jet pump, which body comprises a nozzle and a mixing chamber with a diffuser as well as a channel for supplying a working medium to the nozzle, a channel for withdrawing a medium mixture and a channel for supplying a medium pumped out of a well, wherein the jet pump nozzle is connected via the channel for supplying a working medium to the annular space surrounding the pipe string, and the input of the channel for supplying a medium pumped out of a well and the diffuser output via the channel for withdrawing a medium mixture are connected to the inner cavity of the pipe string, a working medium flow switch is installed in the jet pump body, coaxially with the pipe string, the switch being made as a supporting sleeve spring-loaded against the body and movable along the axial direction, the sleeve having a thrust flange arranged in a bore made in the body, and, above the supporting sleeve thrust flange, an annular channel being made in the pump body, which is connected to the channel for supplying a working medium through the channel for supplying a pumped-out medium and the nozzle, and bypass openings are made in the supporting sleeve as well as a mounting seat for the purpose of installing onto it a sealing unit lowered through the pipe string, said sealing unit having an axial opening for passing through it a logging cable or a wire with logging instruments hanged thereon and used for measuring physical parameters of a well and a medium pumped out of it, and for determining its production rate, or for installing onto the mounting seat a depression insert with a check valve and self-contained instruments hanged below it and used for measuring physical parameters of a medium pumped out of a well and capable of recording formation pressure recovery curves in the under-packer area, wherein, when the supporting sleeve is in its initial upper position, the output of the channel for withdrawing a medium mixture and the channel for supplying a pumped-out medium are closed by the sleeve, and when the supporting sleeve is in its lower position its upper end is located below the output of the channel for withdrawing a medium mixture and the bypass openings of the supporting sleeve being in communication with the input of the channel for supplying a medium pumped out of a well.

2. A well jet device according to claim 1, characterized in that the pipe string length below the jet pump body is made so as to have its inner diameter at least 10% less than the inner diameter of the pipe string at the pipe string length above the jet pump body.

3. A method of operating a well jet device, consisting in that a packer and a jet pump are lowered into a well on a pipe string, a channel for withdrawing a medium mixture and a channel for supplying a pumped-out medium being closed by a support sleeve that is spring-loaded against the jet pump body, the packer is released, and then an acid solution and/or a hydrofracturing fluid is pumped into a producing formation in the well, logging instruments are lowered through the pipe string into the well on a logging cable or a wire passed through the axial opening of a sealing unit, the logging instruments are arranged in the area of the producing formation, and the sealing unit is installed onto a mounting seat in the supporting sleeve located in the jet pump body, geo-physical parameters in the under-packer area, including those in the area of the producing formation, are recorded, then a pressurized working medium is injected along an annular space surrounding the pipe string, which acts on a thrust flange of the supporting sleeve together with the sealing unit through the channel for supplying a working medium, a nozzle, the channel for supplying a pumped-out medium and the annular channel and moves the supporting sleeve into a lower position, thus opening the output of the channel for withdrawing a medium mixture and establishing communication between the bypass openings and the input of the channel for supplying a medium pumped out of a well, at the same time the well is drained by injecting a pressurized working medium through the channel for supplying a working medium and to the jet pump nozzle, and reaction products and/or a hydrofracturing fluid are removed from the producing formation, while regularly measuring the well production rate with the use of logging instruments at 2-5 values of pressure drawdown on the producing formation and continuously recording bottom-hole pressures and the composition of a liquid medium pumped out of the producing formation, further, in the course of draining the well, the logging instruments are moved along the well bore for the purpose of recording geophysical parameters in the under-packer area, including those in the area of the producing formation, and, afterwards, the supply of a working medium is stopped, the logging instruments are removed from the well together with the sealing unit and the logging cable or the wire, thus moving the spring-loaded supporting sleeve into an upper position, a depression insert, together with a check valve and self-contained instruments arranged below the depression insert, is installed onto the mounting seat; then a pressurized working medium is injected through the annular space surrounding the pipe string and, under the influence of said working medium, the supporting sleeve is moved into its lower position, and the producing formation is drained for the second time, and then the supply of the working medium into the jet pump nozzle is stopped, and a formation pressure recovery curve is recorded.

* * * * *